United States Patent [19]

McHugh

[11] Patent Number: 5,041,005

[45] Date of Patent: Aug. 20, 1991

[54] LOW PROFILE CAM-IN SIMM SOCKET

[75] Inventor: Robert G. McHugh, Lewisville, N.C.

[73] Assignee: AMP Incorporated, Harrisburg, Pa.

[21] Appl. No.: 657,588

[22] Filed: Feb. 10, 1991

[51] Int. Cl.[5] ..... H01R 13/00

[52] U.S. Cl. ..... 439/326

[58] Field of Search ..... 439/296, 326, 629-637

[56] References Cited

U.S. PATENT DOCUMENTS

| | | | |
|---|---|---|---|
| 4,713,013 | 12/1987 | Regnier et al. | 439/326 |
| 4,747,790 | 5/1988 | Masuda et al. | 439/326 |
| 4,946,403 | 8/1990 | Billman et al. | 439/326 |

OTHER PUBLICATIONS

AMP Catalog 87-801, entitled "Micro-Edge Simm Connectors", dated Sep. 87.

*Primary Examiner*—Joseph H. McGlynn

*Attorney, Agent, or Firm*—Allan B. Osborne

[57] ABSTRACT

A low profile SIMM socket (10) has been disclosed. Contact elements (14) positioned in cavities (22) in a housing (12) include a non-symmetrical, U-shaped base section (40) having a pair of legs (42,44) with one leg (42) having a depending lead (48) and being positioned in the cavity (22) so that a module receiving recess (16) is orientated at about twenty-five degrees relative to a substrate (124) on which the socket (10) is mounted.

4 Claims, 10 Drawing Sheets

LOW PROFILE CAM-IN SIMM SOCKET

FIELD OF THE INVENTION

The invention disclosed herein relates to SIMM sockets and more particularly to a low profile socket and the contact element providing the low profile.

BACKGROUND OF THE INVENTION

Single in-line memory modules; i.e. "SIMM", represent a high density, low profile single in-line package for electronic components such as dynamic random access memory integrated circuit components. A plurality of these components can be mounted in line on a circuit panel whose height is little more than the length of the components themselves. The circuit panels can in turn be mounted on a printed circuit board daughtercard which can then be mounted on a printed circuit board mothercard. The spacing between adjacent daughtercards would then need to be only slightly greater than the height of the individual circuit panels or single in-line memory modules.

As SIMM sockets became more important in the industry, variations were developed to meet specific requirements. One variation included the 0.050 and 0.100 centerline low profile sockets sold by AMP Incorporated of Harrisburg, Pa. under the trademark MICRO-EDGE SIMM connectors (the terms "connector" and "socket" are interchangeable). These particular sockets were designed to be used with modules having a thickness range of from about 0.047 inches (1.19 mm) to about 0.054 inches (1.37 mm). Subsequent to the development of the MICRO-EDGE SIMM connectors, modules having a thickness range of from about 0.042 inches (mm) to about 0.058 inches (mm) started to appear. Accordingly, it has now become desirable to provide a SIMM socket having contact elements capable of accepting the wider thickness range without changing the normal forces provided by the MICRO-EDGE SIMM connectors.

SUMMARY OF THE INVENTION

According to the present invention, a SIMM socket is provided having contact elements with two spaced apart spring arms which, when positioned in a housing cavity, are pre-deflected. Further, the contact elements include a base section having an elongated leg positioned at about a twenty five degree angle relative to the housing recess.

DESCRIPTION OF THE INVENTION

Figure 1:
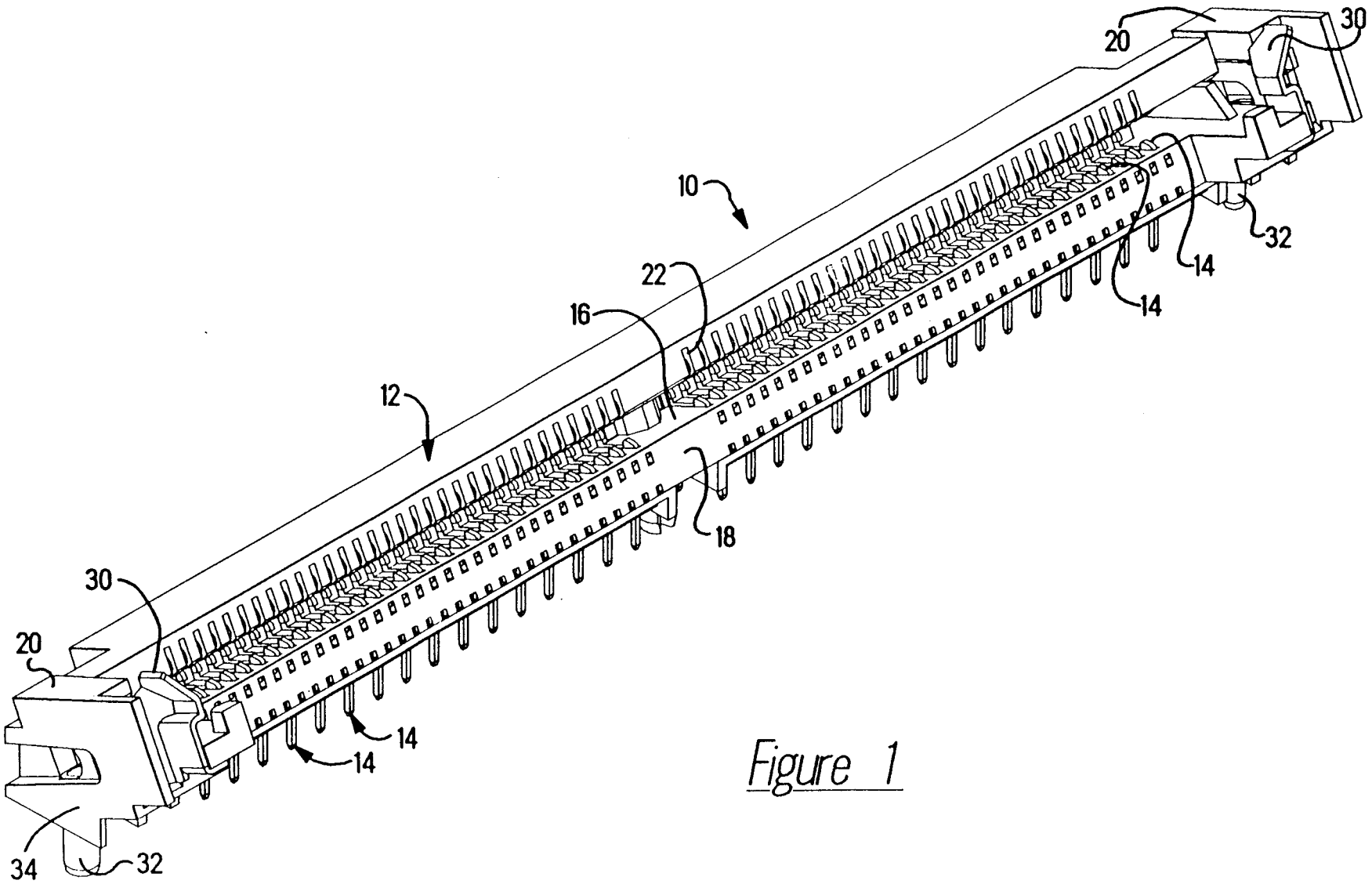
FIG. 1 is a perspective view of a SIMM socket constructed in accordance with the present invention.
Figure 2:
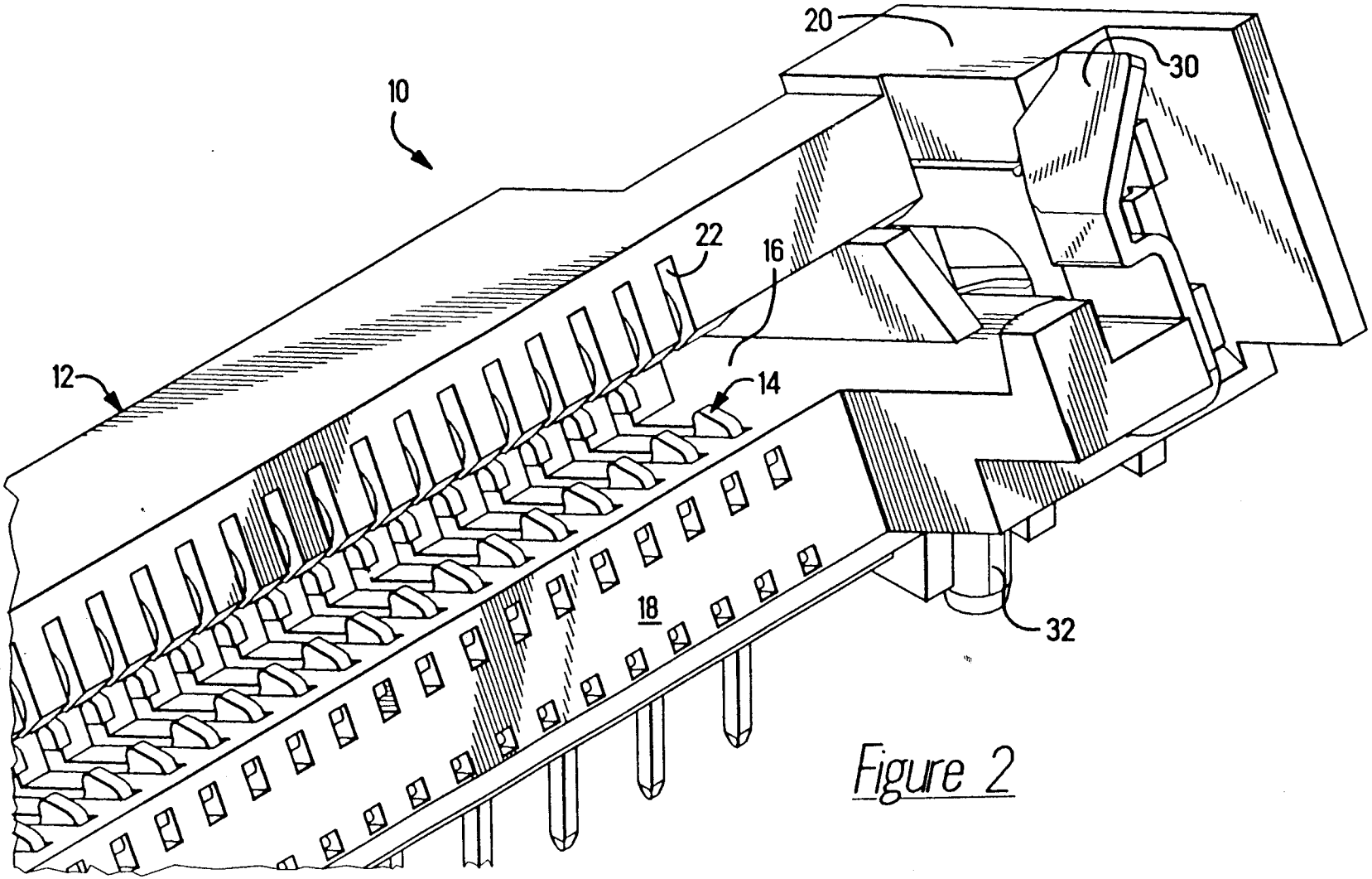
FIG. 2 is an enlarged, perspective view of one end of the socket.

With reference to FIGS. 1 and 2, socket 10 of the present invention includes housing 12 and electrical contact elements 14. A module-receiving recess 16 in housing 12 opens out on surface 18 and extends between end portions 20. A plurality of contact element-receiving cavities 22 are provided along recess 16 and open out on both sides thereof.

Figure 4:
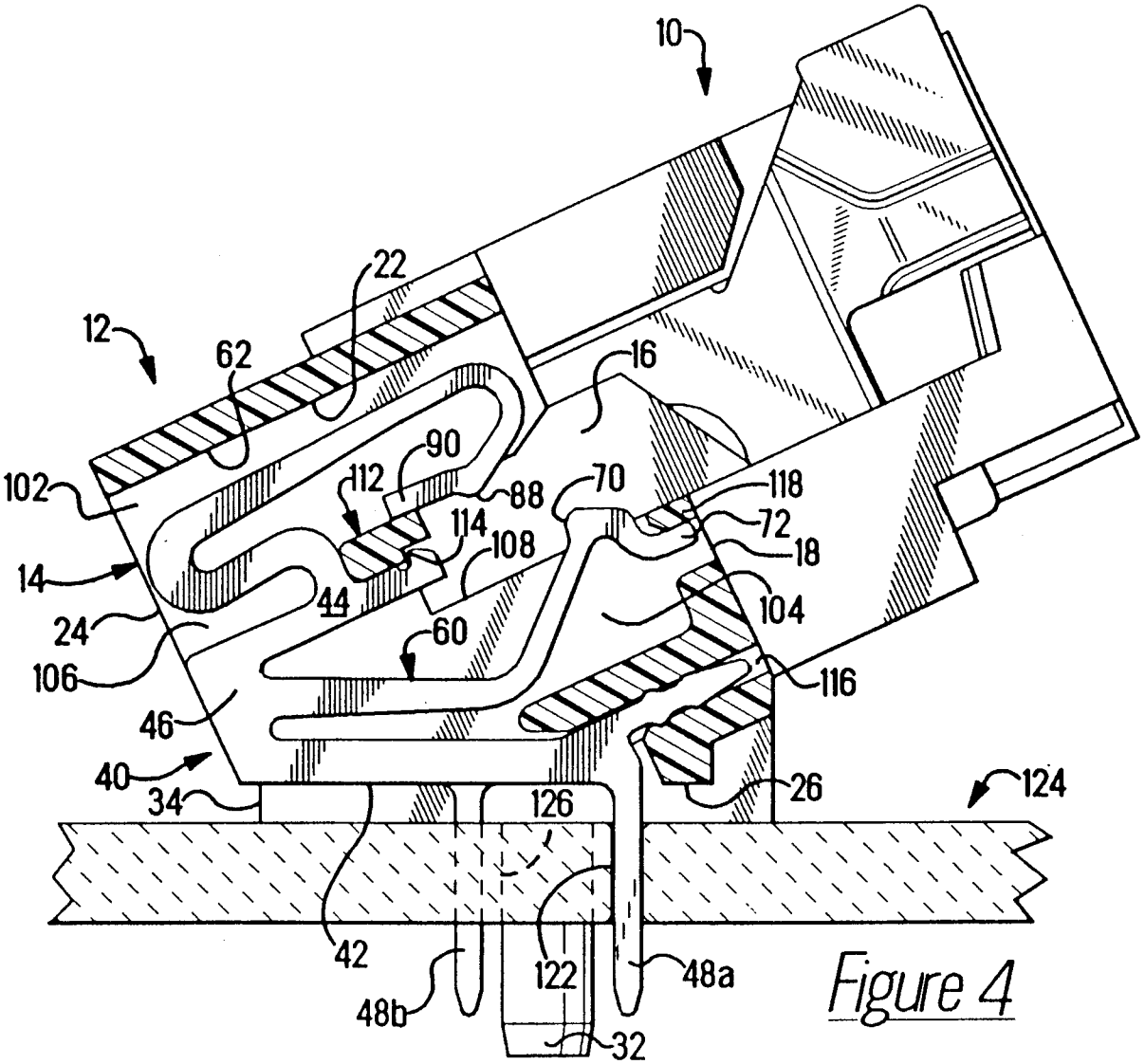
FIG. 4 is a sectioned view of the socket showing the contact element positioned in a cavity in the socket housing.

As shown in FIG. 4, cavities 22 also open out on surface 24, which is opposite surface 18, and on surface 26 which is adjacent and at an oblique angle to surface 24.

End portions 20 carry metal latches 30 which hold a module (FIG. 5) in a final position in recess 16 (reference to U.S. Pat. No. 4,986,765 will provide a detailed description of such latches). Posts 32 extend outwardly from surface 26 at each end portion 20. Further a standoff-rib 34 projects outwardly beyond surface 26 at each end portion 20.

Figure 3A:
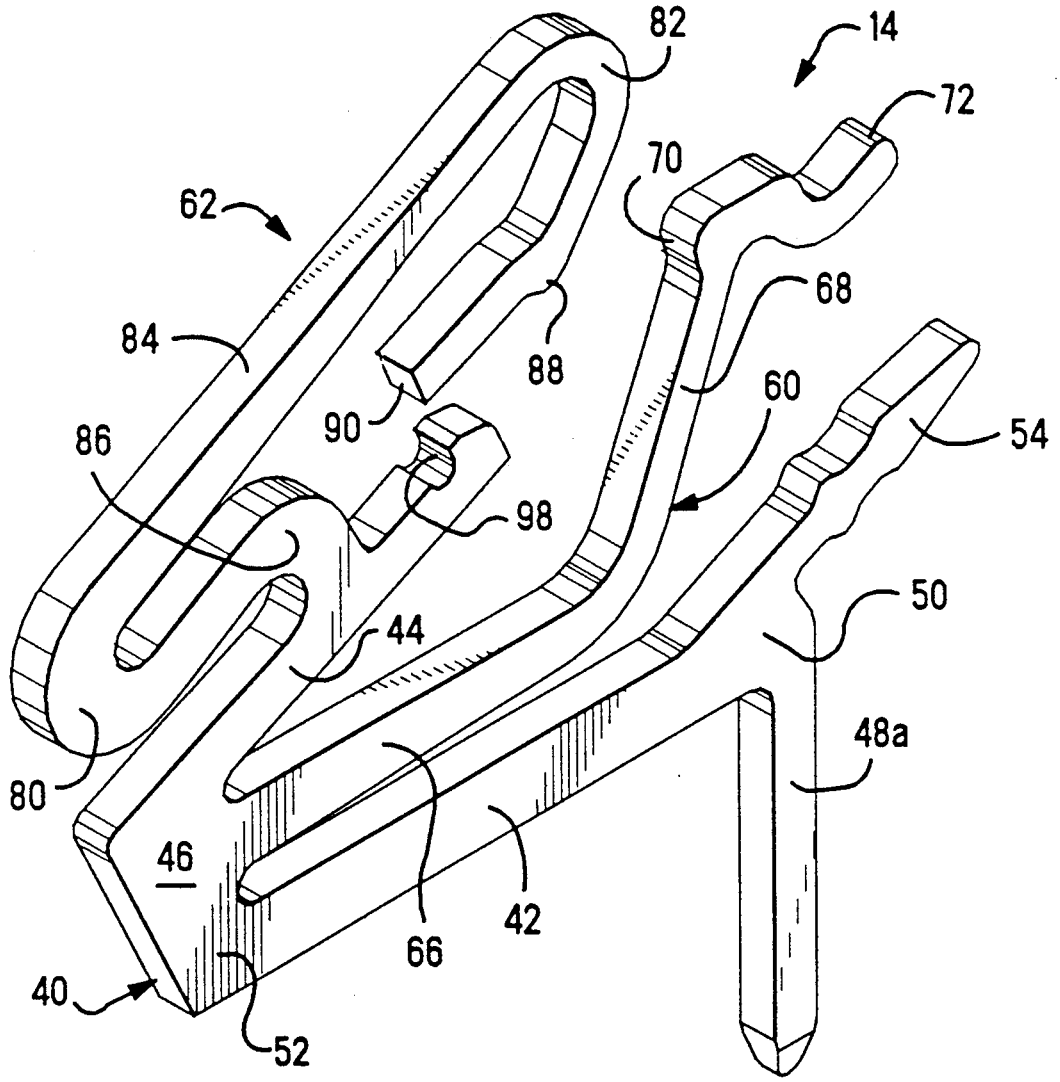
FIGS. 3A and 3B are perspective views of a contact element constructed in accordance with the present invention and used in the socket.
Figure 3B:
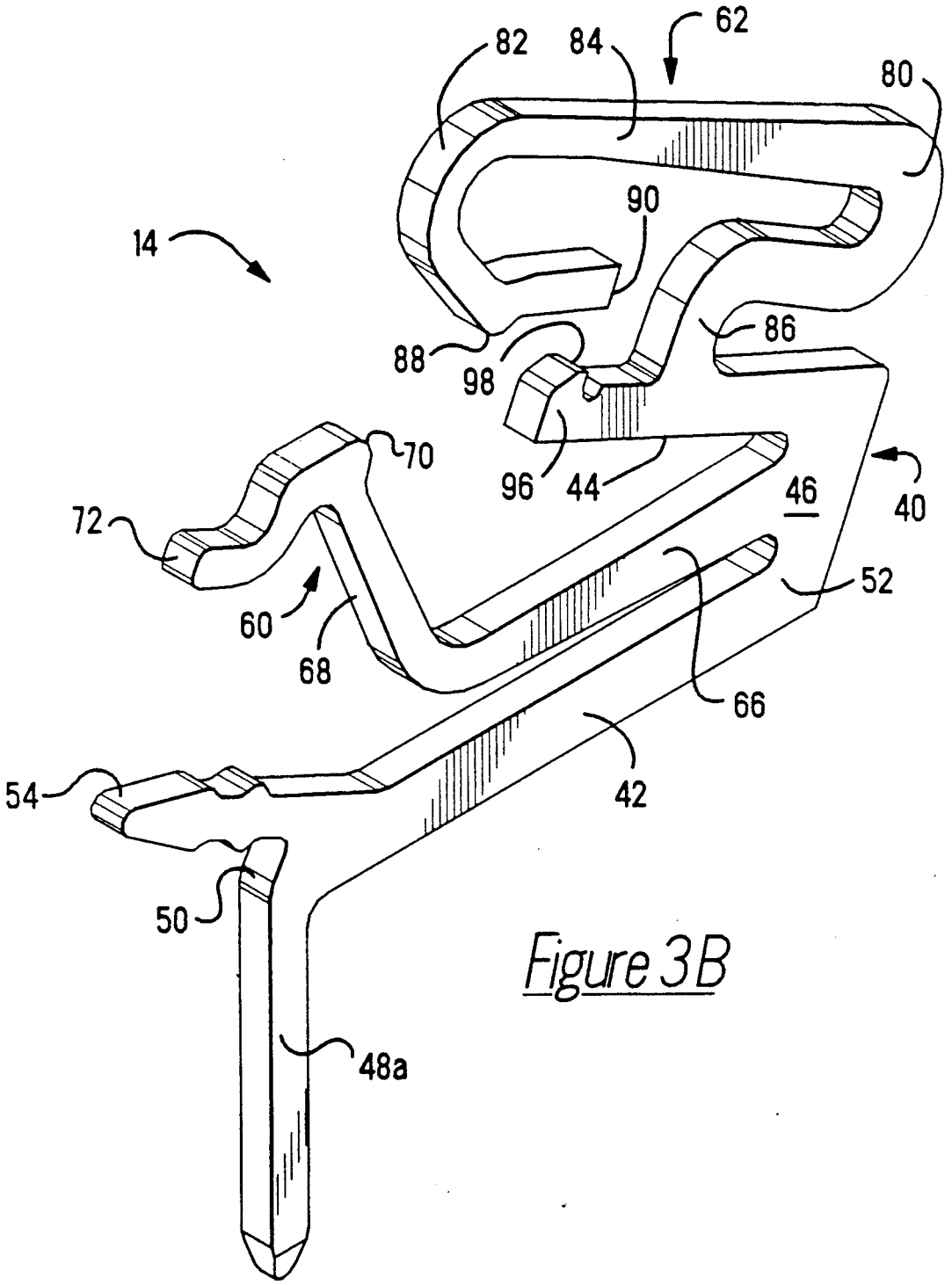

FIGS. 3A and 3B show a contact element 14 from two different angles. The elements basic support structure is a non-symmetrical, U-shaped base section 40 having an elongated leg 42, a short leg 44 and bight 46. Leads 48*a*, 48*b* (lead 48*b* is shown in FIG. 4) extends outwardly from one of two locations along leg 42, either adjacent free end 50 or intermediate ends 50 and 52.

Retaining barb 54 projects obliquely outwardly (relative to leg 42) from free end 50.

Elements 14 carry first and second spring arms 60,62 respectively.

First spring arm 60 extends outwardly from bight 46 and is intermediate legs 42,44.

Spring arm 60 comprises a first portion 66 which parallels elongated leg 42 and a second portion 68 which extends generally away therefrom. The second portion 68 carries an arcuate contact surface 70 which faces second spring arm 62. Tab 72 is attached to free end 74 of second portion 68 and projects away therefrom and lies generally normal to second portion 68 (see FIG. 4).

Second spring arm 62 is generally G or C shaped as seen in FIGS. 3A and 4. Arm 62 includes a pair of U-shaped portions 80,82 joined by a single portion 84. The first U-shaped portion 80 is connected to leg 44 by strap 86 and the second U-shaped portion 82 carries arcuate contact surface 88 near free end 90.

Retaining post 96 is at the free end of leg 44 and includes an undercut to define shoulder 98.

With reference to FIG. 4, a cavity 22 extends around and is open on both sides of recess 16; i.e., cavity 22 includes first and second spaces 102,104 which are interconnected by third space 106. Transverse walls 108 separate adjacent cavities 22.

A longitudinally running central rib 112 defines the floor of recess 16 and includes an outwardly facing shoulder 114. A passage 116 is provided adjacent each cavity space 104 and opens out on surface 26. A restraining bar 118 spans space 104 adjacent surface 18 and the opening of space 104 into recess 16. Elements 14 are loaded into cavities 22 from surface 24 with spring arm 60 entering space 104 and spring arm 62 entering space 102. Elements 14 are retained therein with barb 54 frictionally entering passage 116 and shoulder 114 on rib 112. Contact surface 70 on spring arm 60 and contact surface 88 on spring arm 62 protrudes into recess 16 through openings on respective sides thereof. Spring arm 60 is restrained from protruding too far into recess 16 by restraining bar 118 engaging tab 72. Likewise, rib 112 restrains spring arm 62 from protruding too far into recess 16 from space 102 by engaging free end 90.

Leads 48*a*, 48*b* extend outwardly from cavities 22 through surface 26. Leg 42 of base section 40 extends along the opening on surface 26 as shown and bight 46 extends along the opening on surface 24. Short leg 44 is positioned in interconnecting space 106 and engages rib 112.

As shown in FIG. 4, leads 48 extend through holes 122 in substrate 124 and posts 32 are received in holes 126 shown in phantom.

As is obvious from FIG. 4, socket 10 has been designed to be mounted on substrate 124 so that recess 16 is obliquely orientated with the angle being about twenty five degrees relative thereto.

Figure 5:
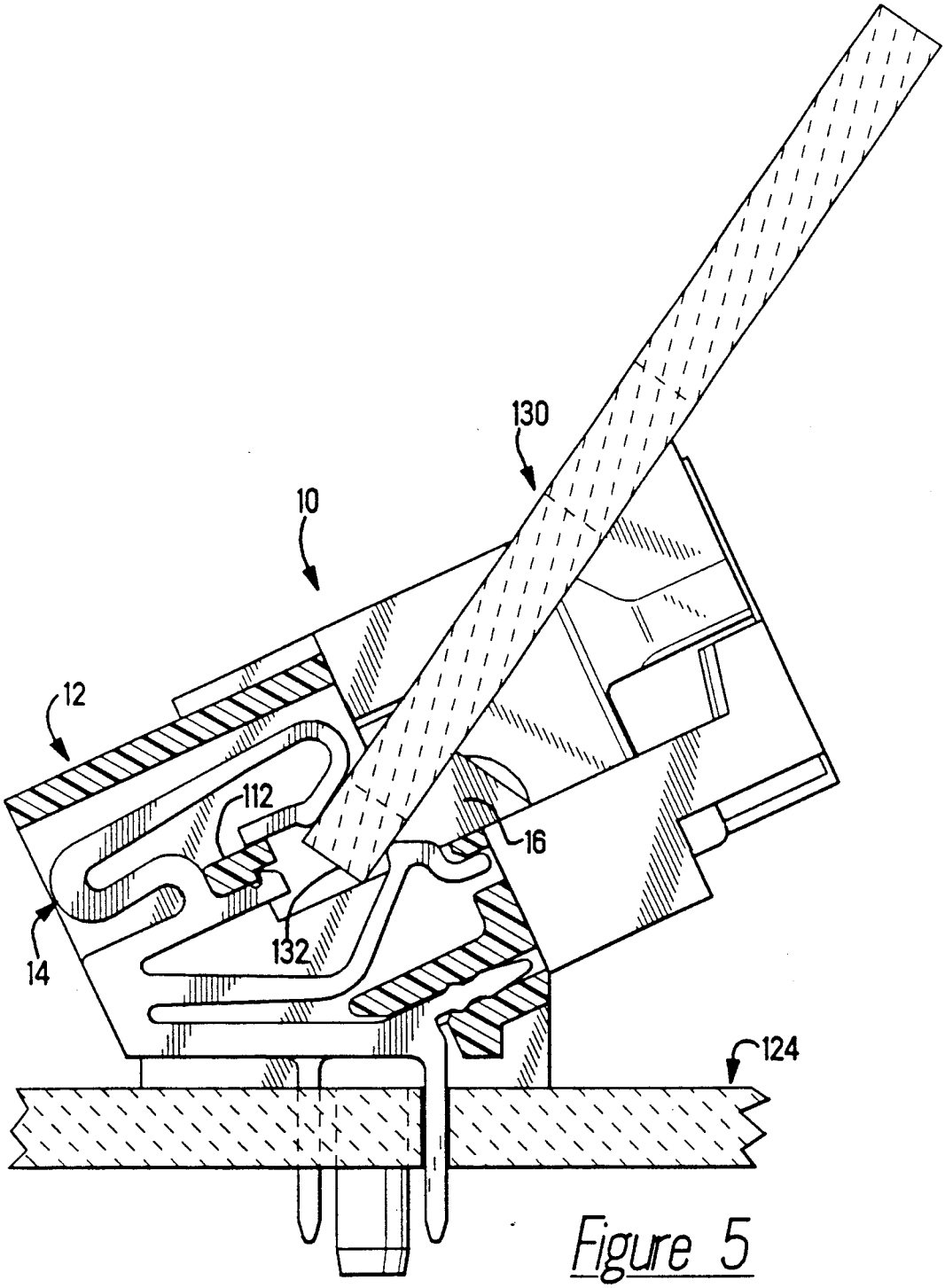
FIG. 5 is a sectional view showing a module being inserted into the socket.
Figure 6:
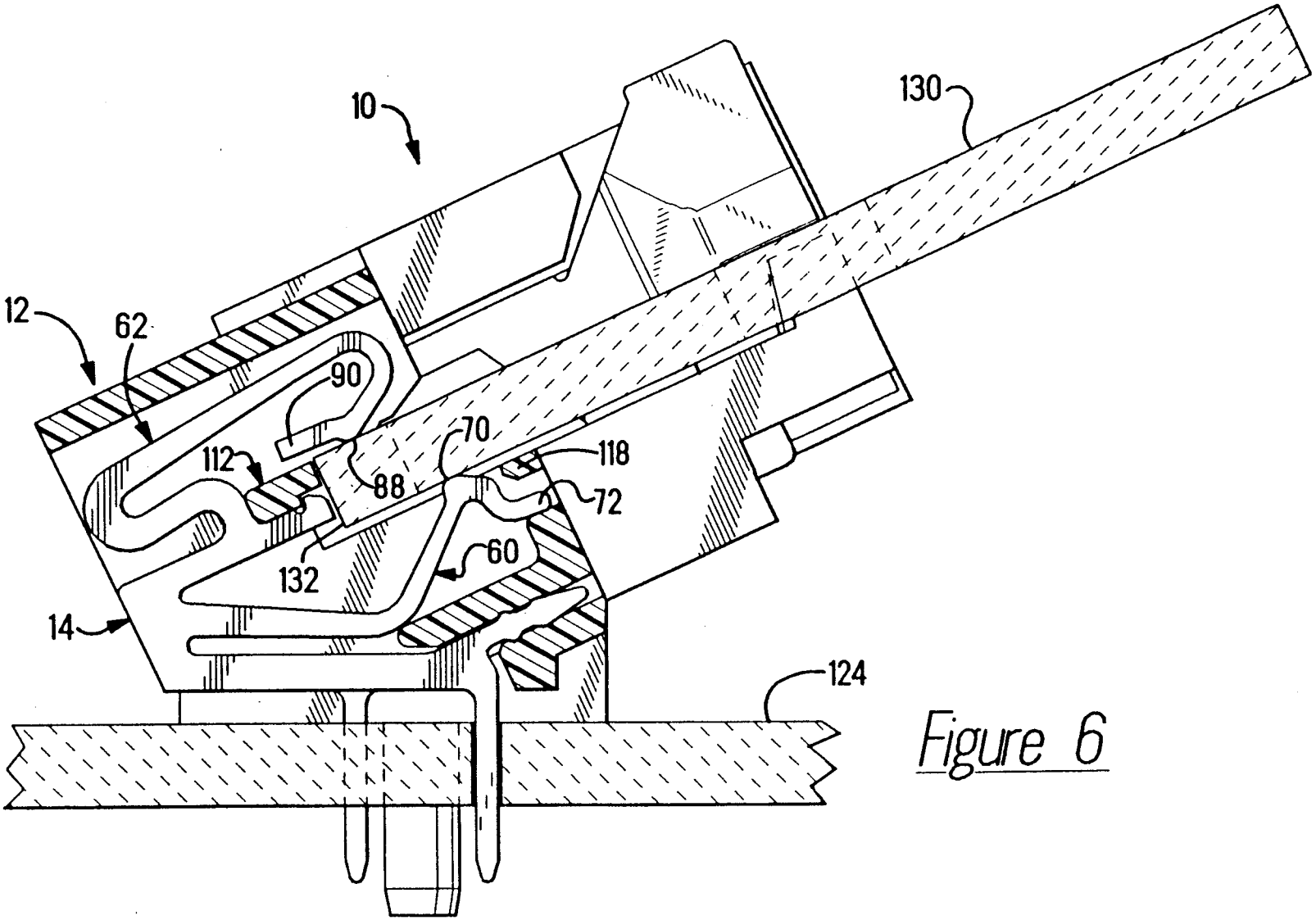
FIG. 6 is a sectional view showing the module fully inserted into the socket.

As shown in FIG. 5, a single in-line memory module 130 is inserted into recess 16 at a steeper angle (than twenty-five degrees) and then, as shown in FIG. 6, is rotated downwardly and pushed completely thereinto with an edge 132 abutting rib 112. During the insertion process, spring arms 60,62 are cammed back into spaces 104, 102 respectively and contact surfaces 70,88 electrically engages traces (not shown) on module 130. As is evident, surfaces 70,88 slide on the traces during the insertion and thereby wipes the engaging surfaces clean. FIG. 6 shows tab 72 pushed away from bar 118 and free end 90 pushed away from rib 112. With spring arms 60,62 thus resiliently deformed, the required normal force against the module traces are maintained for good electrical conductivity through the engaging surfaces.

Figure 7A:
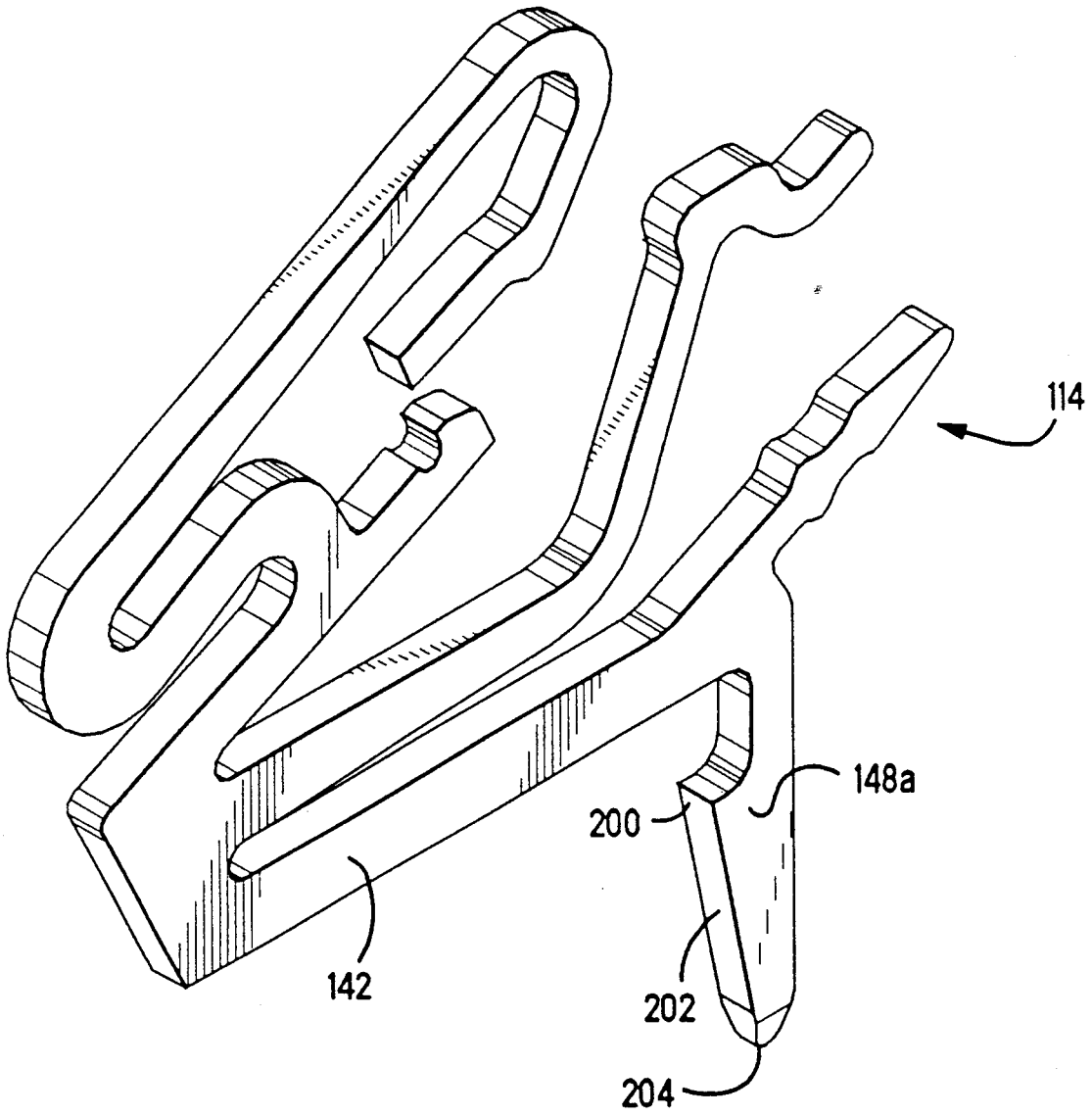
FIGS. 7A and 7B are perspective views of a second embodiment of a contact element constructed in accordance with the present invention.
Figure 7B:
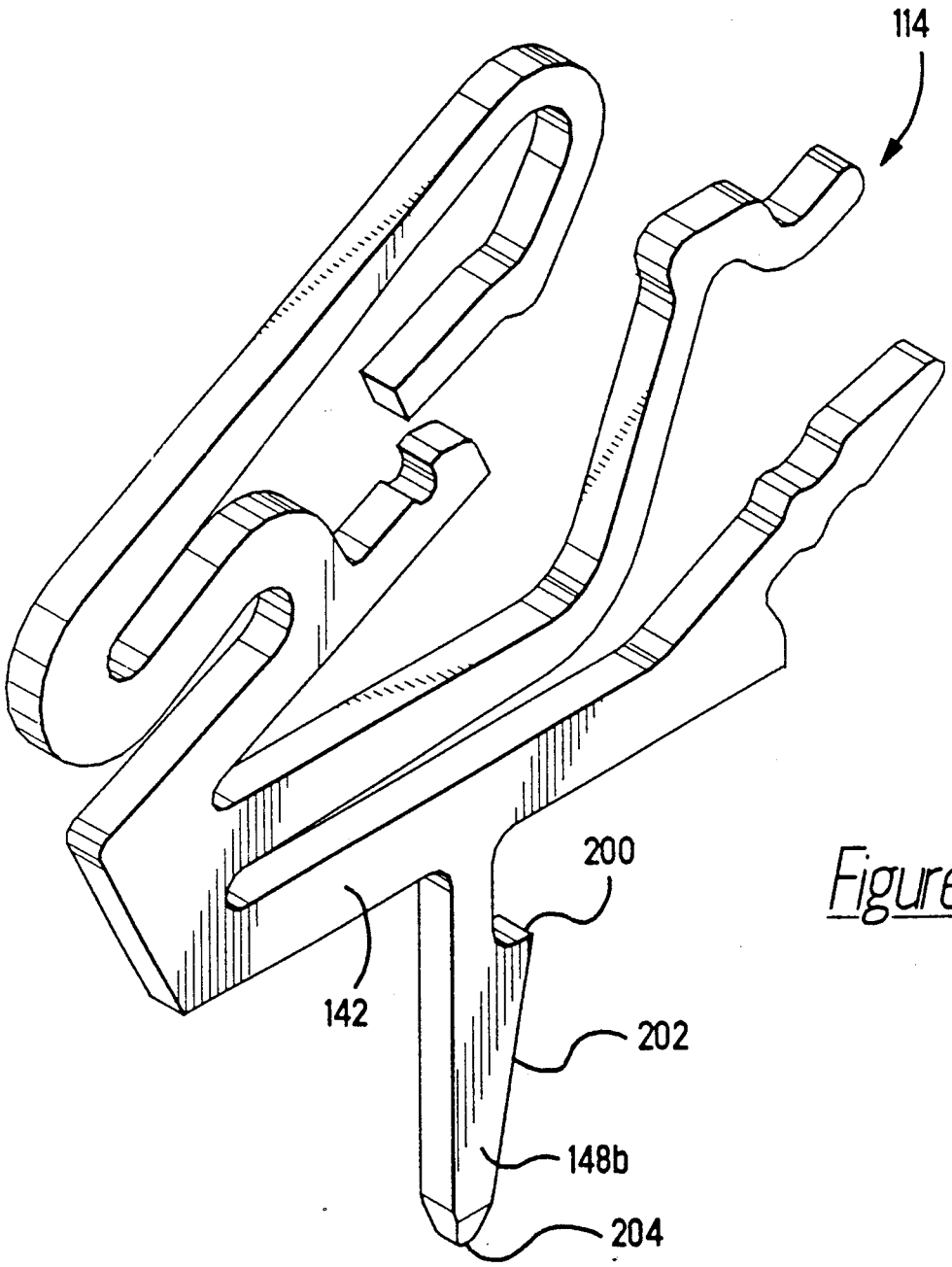
Figure 8:
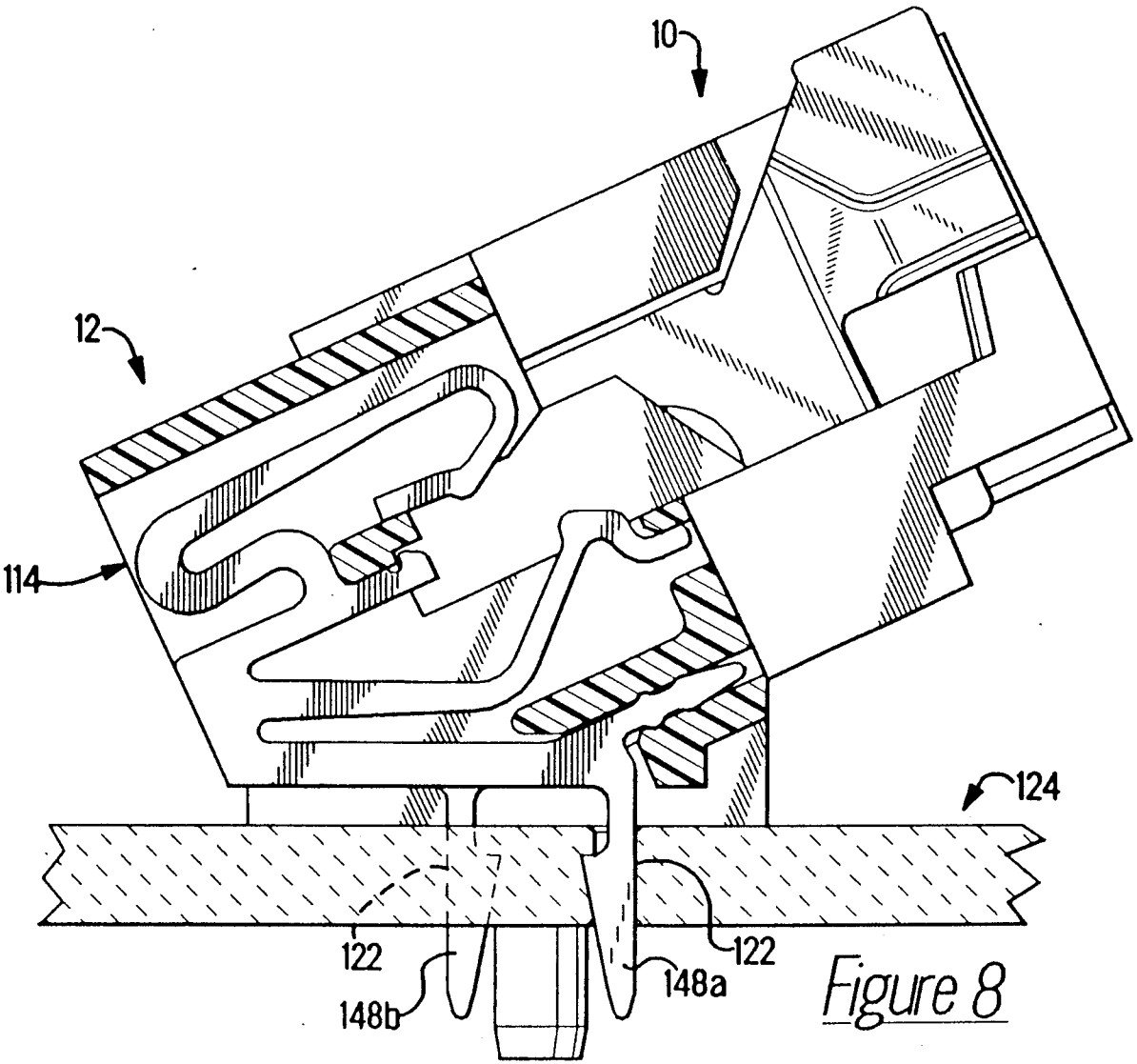
FIG. 8 is a sectioned view of a socket with the contact elements of FIGS. 7A and 7B mounted on a substrate.

FIGS. 7A and 7B illustrate a second embodiment of the contact elements. Elements 114 shown therein are provided with leads 148*a*, 148*b* having a barb 200; i.e., a side 202 is beveled obliquely outwardly from free end tip 204 towards elongated leg 142. The increasing width ends at about three quarters of the length from tip 204. As shown, barb 200 on lead 148*a* faces in one direction and barb 200 on lead 148*b* faces in the opposite direction so that when elements 114 are loaded into housing 12, barbs on adjacent elements 114 face each other. This is illustrated in FIG. 8 which also shows how barbs 200 engage the walls of holes 122. It has been found that barbs 200 provide better stability and retention.

An important advantage of the socket of the present invention is that it provides a low profile on the substrate. However, because the modules are initially inserted at an angle of about fifty-five degrees relative to the plane of the substrate, the low profile does not hamper insertion or removal. Further, with both spring arms being pre-deflected, the arms may be made having a low spring rate resulting in little variation in normal force with changes in module thickness. Pre-deflecting the spring arms also reduce the force needed to insert and withdraw a module.

I claim:

1. A low profile SIMM socket (10) comprising:

a housing (12) having a module-receiving recess (16) and a plurality of cavities (22) on each side of and opening into said recess (16) said housing (12) further having first and second pre-deflection means (118,112) in said cavities (22); and a plurality of contact elements (14) disposed in respective cavities (22); said elements (14) having a non-symmetrical U-shaped base section (40) comprising an elongated leg (42), a short leg (44) and a bight (46) joining and extending between said legs (42,44) a first spring arm (60) extending outwardly from said bight (46) and having a contact surface (70) protruding into said recess (16) from one side thereof and a tab (72) engaging said first predeflecting means (118) and a second C-shaped spring arm (62) extending outwardly from said short leg (44) and having a contact surface (88) protruding into said recess (16) from another side thereof and a free end (90) engaging said second predeflecting means (112), said elements (14) further having a lead (48) extending outwardly from said elongated leg (42) for electrically engaging a substrate (124), said elongated leg (42) being orientated so that upon mounting the socket (10) on a substrate (124), said recess (16) is at a twenty-five degree angle relative to the substrate (124).

2. The socket (10) of claim 1 wherein said first deflecting means (118) includes a retaining bar (118) spanning respective cavities (22) between transverse walls (108) adjacent one said opening into said recess (16).

3. The socket (10) of claim 1 wherein said second pre-deflecting means (112) includes a central rib (112) defining a floor of said recess (116).

4. The socket (10) of claim 1 wherein said lead (48) includes a barb (200) thereon.

* * * * *